US009718655B2

(12) United States Patent
Wimmer

(10) Patent No.: US 9,718,655 B2
(45) Date of Patent: Aug. 1, 2017

(54) LOADING CRANE JIB

(71) Applicant: Palfinger AG, Salzburg (AT)

(72) Inventor: Eckhard Wimmer, Hallein (AT)

(73) Assignee: PALFINGER AG, Salzburg (AT)

( * ) Notice: Subject to any disclaimer, the term of this patent is extended or adjusted under 35 U.S.C. 154(b) by 0 days.

(21) Appl. No.: 14/018,765

(22) Filed: Sep. 5, 2013

(65) Prior Publication Data

US 2014/0001140 A1 Jan. 2, 2014

Related U.S. Application Data

(63) Continuation of application No. PCT/AT2012/000056, filed on Mar. 9, 2012.

(30) Foreign Application Priority Data

Mar. 10, 2011 (AT) ..... GM133/2011

(51) Int. Cl.
*B66C 23/70* (2006.01)
*B66C 23/00* (2006.01)
(Continued)

(52) U.S. Cl.
CPC ..... *B66C 23/705* (2013.01); *B66C 23/42* (2013.01); *B66C 23/54* (2013.01); *F15B 11/205* (2013.01); *F15B 13/07* (2013.01)

(58) Field of Classification Search
CPC ..... B66C 23/705; B66C 23/54; B66C 23/42; B66C 23/04; B66C 23/545; B66C 23/56;
(Continued)

(56) References Cited

U.S. PATENT DOCUMENTS 5,355,769 A 10/1994 Kottke
5,501,346 A * 3/1996 Wimmer ..... B66C 23/54 212/231
(Continued)

FOREIGN PATENT DOCUMENTS

CN 1243921 2/2000
CN 201318349 9/2009
(Continued)

OTHER PUBLICATIONS

International Search Report (ISR) issued May 18, 2012 in International PCT Application PCT/AT2012/000056.
(Continued)

*Primary Examiner* — Sang Kim
*Assistant Examiner* — Juan Campos, Jr.
(74) *Attorney, Agent, or Firm* — Wenderoth, Lind & Ponack, L.L.P.

(57) ABSTRACT

A hydraulically actuatable jib for a loading crane includes at least two jib extensions, the first jib extension being designed as an outer jib extension and the second jib extension being designed as an inner jib extension. At least two feed cylinders extend and react the at least two jib extensions. A hydraulic circuit for a working fluid includes a retraction line for retracting the feed cylinders in a pressurized manner, and the retraction line opens into the feed cylinder of the outer jib extension. A tank is provided for releasing the working fluid, and a control valve can be switched into an open position when the outer jib extension reaches a defined retraction position, particularly when the outer jib extension is substantially fully retracted. The valve thereby supplies the feed cylinder of the inner jib extension with pressurized working fluid.

18 Claims, 6 Drawing Sheets

(51) Int. Cl.

| | |
|---|---|
| ***F15B 11/20*** | (2006.01) |
| ***F15B 13/07*** | (2006.01) |
| ***B66C 23/42*** | (2006.01) |

(58) Field of Classification Search
CPC ..... B66C 23/701; B66C 23/82; B66C 13/12; F15B 11/20; F15B 11/205
USPC ..... 212/299, 349, 300, 238, 230, 264
See application file for complete search history.

(56) References Cited

U.S. PATENT DOCUMENTS

| | | | | |
|---|---|---|---|---|
| 6,029,559 | A * | 2/2000 | Barthalow | B66C 23/705 91/167 R |
| 2004/0154290 | A1 | 8/2004 | Kruppa et al. | |

FOREIGN PATENT DOCUMENTS

| | | |
|---|---|---|
| EP | 0 566 720 | 1/1996 |
| EP | 0 743 275 | 11/1996 |
| EP | 1 270 494 | 1/2003 |
| IT | 1 233 225 | 3/1992 |
| JP | 60-196409 | 10/1985 |
| JP | 2002-213403 | 7/2002 |
| RU | 2213042 | 9/2003 |
| WO | 96/41764 | 12/1996 |
| WO | 2010/110759 | 9/2010 |

OTHER PUBLICATIONS

Austrian Patent Office Search Report issued Jan. 19, 2012 in Austrian Patent Application GM 133/2011.
Chinese Search Report in corresponding Chinese Patent Application No. 201280012499.7.

* cited by examiner

LOADING CRANE JIB

BACKGROUND OF THE INVENTION

1. Field of the Invention

The object of the invention is to provide an improved hydraulically actuable jib for a loading crane.

2. Description of Related Art

Hydraulically actuable jibs for loading cranes are already known in large numbers from the state of the art. Thus, for example, EP 0 566 720 B1 of Nov. 10, 1992, discloses a multi-stage telescopic jib, in particular for a loading crane on a truck, wherein a respective hydraulic unit having a piston and a cylinder is arranged between successive telescopic arms arranged one within the other, wherein, at least in regard to the cylinder of the innermost arm, a tube projects from the cylinder end axially into the cylinder chamber, the tube, when the piston is at least partially retracted, extending into the hollow piston rod in sealed relationship with the piston, and thus sealing off the cylinder chamber with respect to the internal chamber in the hollow piston rod, wherein the internal chamber in each hollow piston rod is connected to the cylinder chamber of the next inner hydraulic unit by way of a preferably rigid line, and the internal chamber in each hollow piston rod communicates with the cylinder chamber of the same hydraulic unit when the piston is fully extended.

BRIEF SUMMARY OF THE INVENTION

The invention concerns a hydraulically actuable jib for a loading crane, comprising:

- at least two jib extensions, wherein a first one of the one jib extensions is in the form of an outer jib extension and a second one of the jib extensions is in the form of an inner jib extension, and
- at least two thrust cylinders for extension and retraction of the at least two jib extensions,
- a hydraulic circuit for a working medium—in particular oil—comprising a retraction line for pressure-actuated retraction of the thrust cylinders, wherein the retraction line opens into the thrust cylinder of the outer jib extension, and
- a tank for delivery of the working medium, and
- a switching valve which is switchable into an open position by the attainment of a defined retraction position of the outer jib extension—in particular when the outer jib extension is substantially fully retracted—and thereby feeds the thrust cylinder of the inner jib extension with pressurized working medium.

The invention further concerns a loading crane comprising a hydraulically actuable jib and in addition a vehicle comprising such a loading crane.

BRIEF DESCRIPTION OF THE DRAWINGS

Details and advantages of the present invention are described more fully hereinafter by means of a specific description with reference to the embodiments by way of example illustrated in the drawings in which.

DETAILED DESCRIPTION OF THE INVENTION

Figure 1:
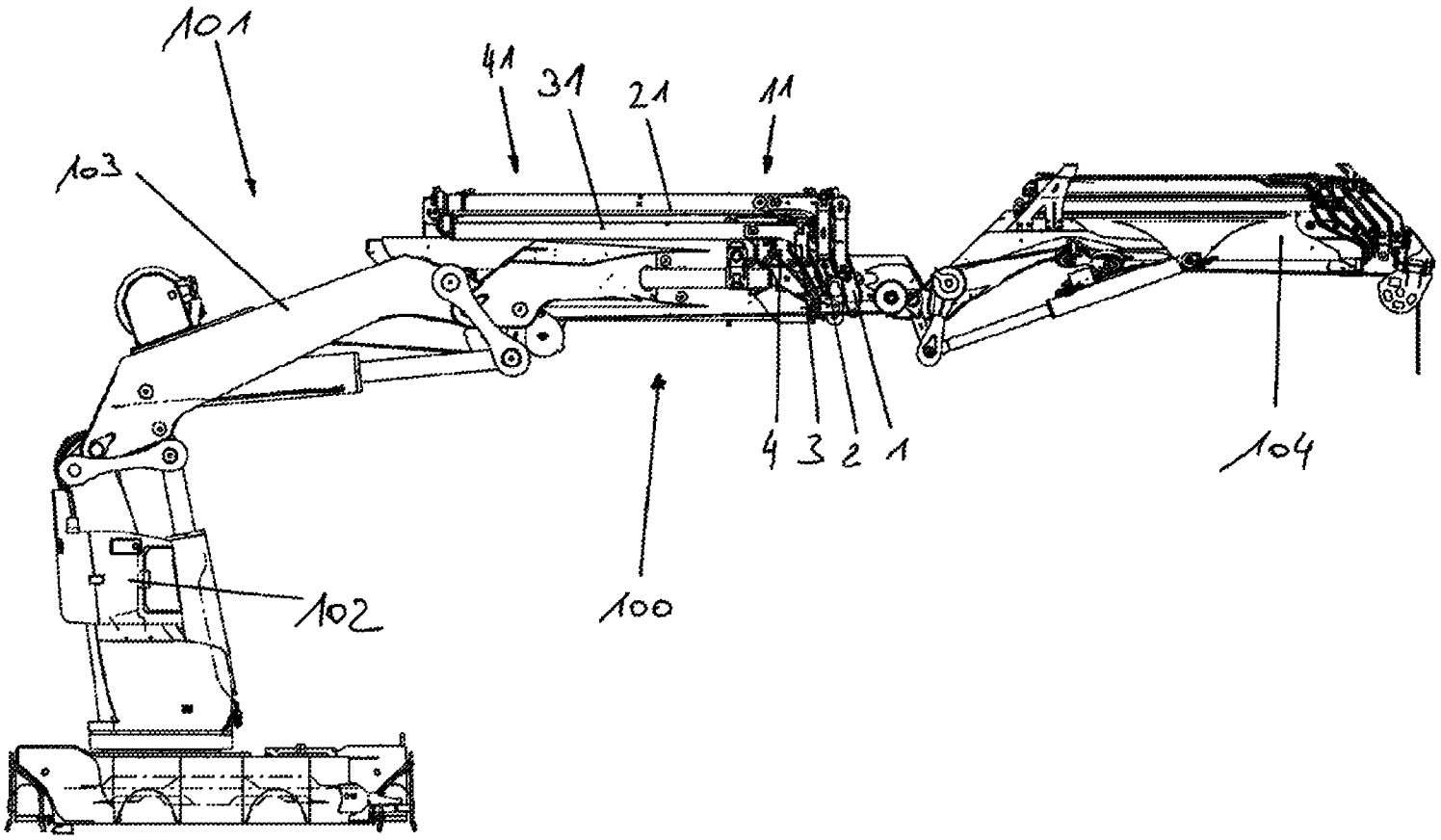
FIG. 1 shows a side view of a loading crane with hydraulically actuable jibs and jib extensions.

The invention concerns a loading crane comprising a hydraulically actuable jib. Such a hydraulically actuable jib can be advantageously used specifically in relation to loading cranes.

A vehicle may comprise such a loading crane. Such loading cranes with hydraulically actuable jibs can advantageously be used specifically on vehicles.

In the invention, the fact that the working medium of the retraction line between the tank and the inlet opening at the thrust cylinder of the outer jib extension does not communicate with the thrust cylinder of the inner jib extension in any position of the thrust cylinder of the inner jib extension as long as the outer jib extension has not reached its retraction position provides a retraction line which is independent of the thrust cylinder of the inner jib extension, whereby the thrust cylinder of the outer jib extension can be pressurized directly with the working medium—even when the thrust cylinder of the inner jib extension is fully extended.

That retraction line makes it possible to feed oil at the retraction side to the outer thrust cylinder—that is to say the thrust cylinder which is furthest away from the crane mast—when it is not yet fully retracted, until it is entirely retracted. In that condition the switching valve is actuated—that is to say opened—to the inner thrust cylinder—this therefore being the thrust cylinder which is next rearwardly and which is disposed closer to the crane mast, whereby oil is no longer fed to the outer thrust cylinder as it is already fully retracted. The oil flows by way of the control valve into the inner thrust cylinder and causes it to retract.

This therefore provides a sequential control whereby one thrust cylinder after the other is retracted and in that situation the retraction line opens directly into the outer thrust cylinder. In this respect, it should be pointed out that "inner thrust cylinder" means the thrust cylinder of the inner jib extension and "outer thrust cylinder" means the thrust cylinder of the outer jib extension, those expressions being known to one skilled in the art as customary abbreviations.

In the normal case, in that respect, the outer jib extension is that of a smaller diameter and the inner jib extension is that of a larger diameter, but naturally this could also be reversed—with respect to the outer and inner jib extension and/or the smaller and larger diameter.

Further advantageous configurations of the invention are defined in the appendant claims.

It has proven to be particularly advantageous if the retraction line passes through at least the thrust cylinder of the inner jib extension without the working medium in the retraction line communicating with the thrust cylinder during the passage therethrough. It is possible to achieve an extremely compact structure by virtue of passing the retraction line through the thrust cylinder of the inner jib extension.

In a preferred embodiment it can be provided that the retraction line is adapted to be telescopic in the interior of the thrust cylinder of the inner jib extension. A telescopic configuration for the retraction line makes it possible to adapt the length of the retraction line to the effective length of the thrust cylinder, that is to say the telescopic retraction line can move together with the thrust cylinder.

It can further preferably be provided that the retraction line has at least two internested tubes which are adapted to be telescopically moveable relative to each other. A telescopic configuration can particularly preferably be produced by two internested tubes.

It has proven to be particularly advantageous if a seal is provided between the two internested tubes. The provision of a seal means that it is possible to provide that the working medium which passes within the internested tubes cannot escape therefrom and flow into the internal space in the thrust cylinder.

It can particularly preferably be provided that the thrust cylinder of the inner jib extension has at least one cylinder, at least one piston and at least one piston rod wherein one of the two tubes is provided stationarily in the cylinder of the thrust cylinder and the second tube is provided stationarily in the piston rod of the thrust cylinder. The stationary provision of the two tubes in the thrust cylinder can ensure that both tubes are moved uniformly together with the thrust cylinder.

In that respect, it has proven to be particularly advantageous if the outer one of the two tubes has an opening in a peripheral surface of the tube, the opening being provided at an end region of the tube. The provision of an opening at an end region of the tube can provide that, when the tubes are substantially fully retracted, the working medium can pass from the cylinder into the piston rod by way of the opening. It will be appreciated that it could equally also be envisaged that this functionality can be implemented in a different way, for example by a check valve opening in the one of the substantially fully extended tubes, whereby the working medium could pass from the cylinder into the piston rod.

In a preferred embodiment, it can be provided that the piston has at least one extension passage, the extension passage extending from a cylinder chamber into a piston rod chamber. The working medium can flow from the cylinder chamber into the piston rod chamber by way of an extension passage in the piston.

It has further proven to be advantageous if the piston has at least one retraction passage, the retraction passage extending from the cylinder chamber into the piston rod chamber, a check valve being provided in the retraction passage. A retraction passage in the piston can provide that the working medium can flow from the piston rod chamber into the cylinder chamber during retraction.

It has been found to be advantageous if the piston rod has at least one piston rod passage, the piston rod passage extending from an end region of the piston rod towards the other end region of the piston rod, the switching valve being arranged at the one end region and a chamber surrounding the piston rod being provided at the other end region, the chamber which surrounds the piston rod being provided in the cylinder of the thrust cylinder. The implementation of a piston rod passage can provide that the pressurized working medium can flow into the chamber surrounding the piston rod and thereby retract the thrust cylinder.

Preferably, it can further be provided that at least one check valve is provided on the piston rod passage. The provision of a check valve on the piston rod passage means that, upon extension of the thrust cylinder, the working medium which is in the chamber surrounding the piston rod can escape therefrom and can flow away by way of the check valve—by means of passing through the piston rod passage.

In a possible embodiment, it can be provided that the switching valve is in the form of a directional control valve—preferably a 2/2-way valve.

In a preferred embodiment, it can be provided that the switching valve is adapted to be mechanically actuable. That can contribute to an inexpensive variant of a switching valve.

In that respect, it is particularly preferably provided that the jib has at least one—preferably at least two—further inner jib extension(s) with a thrust cylinder or cylinders, wherein the working medium of the retraction line between the tank and the inlet opening at the thrust cylinder of the outermost jib extension does not communicate with the thrust cylinders of the inner jib extensions in any position of the thrust cylinders of the inner jib extensions as long as the outermost jib extension has not reached its retraction position. The use of a plurality of inner jib extensions and associated thrust cylinders can contribute to enhancing the reach of the jib.

FIG. 1 shows a loading crane 101 with a crane mast 102, a first jib 103 and a second jib 100. The hydraulically actuable jib 100 has a plurality of jib extensions 1, 2, 3 and 4. The jib extensions 1, 2, 3 and 4 are extended and retracted with associated thrust cylinders 11, 21, 31 and 41, respectively.

In this preferred embodiment, the loading crane 101 has a further third jib 104 which has jib extensions which are also telescopic and hydraulically actuable.

Preferably, such loading cranes 101 are mounted on vehicles. However, they are also used in stationary situations.

Figure 2:
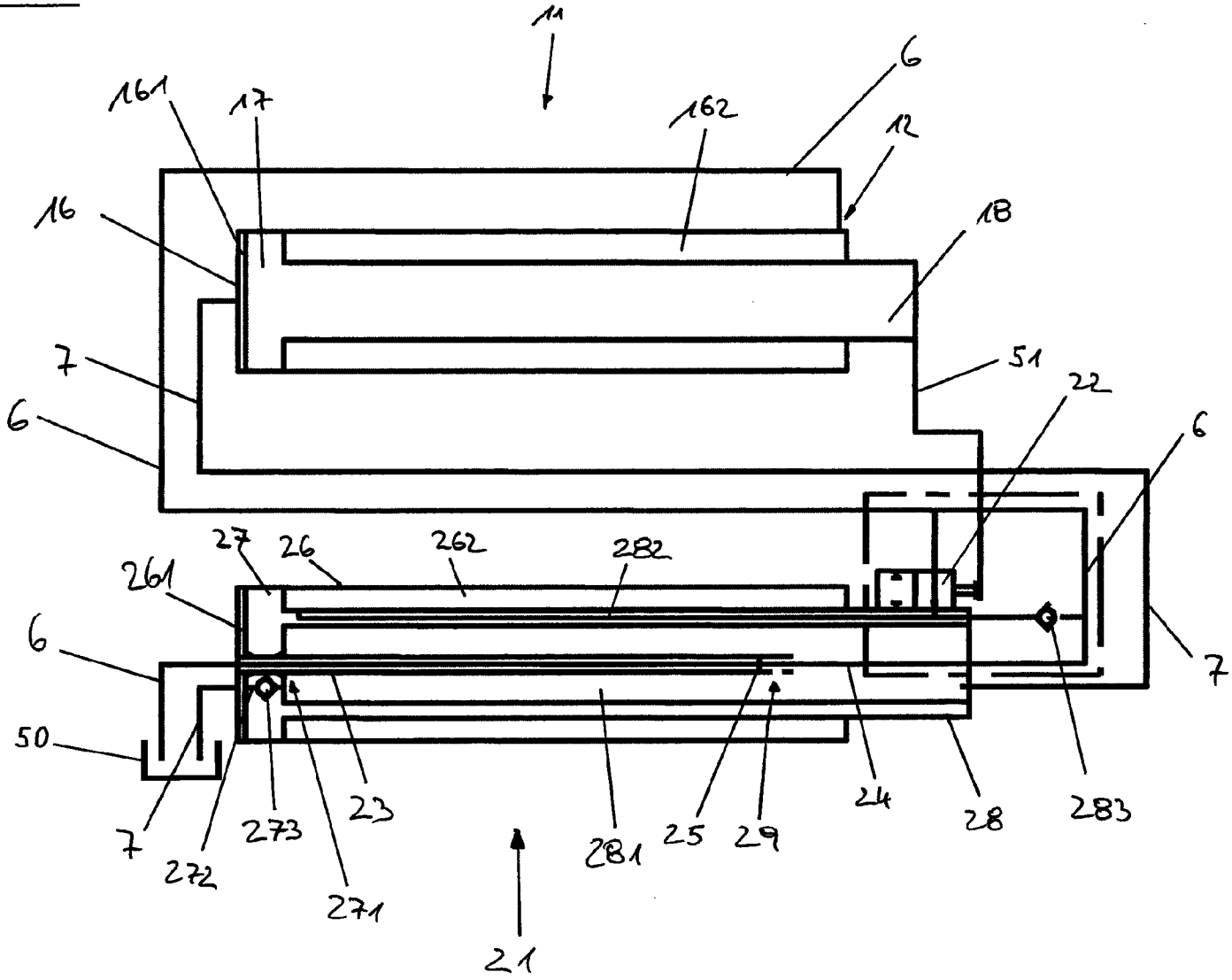
FIG. 2 shows a diagrammatic view of two thrust cylinders wherein one thrust cylinder is provided for an outer jib extension and one for an inner jib extension, both thrust cylinders being in the retracted condition.

FIG. 2 shows a diagrammatic view of two thrust cylinders 21 and 11 for two jib extensions (not shown), an outer jib extension 1 and an inner jib extension 2. In this respect, the thrust cylinder 11 is arranged at the outer jib extension 1 and the thrust cylinder 21 is arranged at the inner jib extension 2. Both thrust cylinders 11 and 21 are completely retracted in FIG. 2.

Extension Process:

For extension purposes, the extension line 7 or the working medium 5 (not shown) therein is subjected to pressure. The extension line 7 opens into the cylinder chamber 261 of the cylinder 26. By virtue of pressurization, the working medium 5 is propagated in the cylinder 26 or its cylinder chamber 21 and, in that case, displaces the piston 27 and therewith also the piston rod 28, so the piston rod 28 extends. Hitherto, the working medium 5 was only able to propagate in the cylinder chamber 261, whereby it is exclusively the thrust cylinder 21 that is extended, and not the thrust cylinder 11.

In this preferred embodiment, the piston rod 28 has at least one piston rod passage 282, the piston rod passage 282 extending from one end region of the piston rod 28 towards the other end region of the piston rod 28, the switching valve 22 being arranged at the one end region and a chamber 262 which surrounds the piston rod 28 being provided at the other end region, wherein the chamber 262 which surrounds the piston rod 28 is provided in the cylinder 26 of the thrust cylinder 21.

So that the piston rod 28 can extend, the working medium 5 (not shown) which is in the chamber 262 surrounding the piston rod 28 must escape. For that purpose, the working medium 5 can flow out of the thrust cylinder 21 from the chamber 262 surrounding the piston rod 28 by way of the piston rod passage 282 and the check valve 283. The working medium 5 can then flow back into a tank 50 by way of the two telescopic tubes 23 and 24.

In this preferred embodiment, the telescopic tubes 23 and 24 are provided in the interior of the thrust cylinder 21, whereby it is possible to achieve a very compact thrust cylinder 21.

After the piston rod 28 is substantially completely extended there is an opening between the cylinder chamber 261 and the piston rod chamber 281. Those two chambers 261 and 281 are connected together by way of the extension passage 271 which is now open. Opening of the extension passage 271 was made possible by an opening 29 provided in the peripheral surface of the tube 23, the opening 29 being at an end region of the tube 23. With this preferred embodiment, the opening 29 is in the form of a through aperture in the peripheral surface of the tube 23. Working medium 5 can now flow through the opening 29 and the extension passage 27 from the cylinder chamber 261 into the piston rod chamber 281 and from there further by way of the extension line 7 to the cylinder chamber 161 of the cylinder 16 of the thrust cylinder 11. The pressurized working medium 5 is now propagated in the cylinder chamber 161 of the thrust cylinder 11 whereby the piston 17 and the piston rod 18 are extended.

The working medium 5 in the chamber 162 surrounding the piston rod 18 can flow away by way of the retraction line 6 in this extension process. In addition, as is usual, the working 1 medium 5 flows back into the tank 50 by way of the two tubes 24 and 23. As already mentioned, that is in turn preferably effected through the thrust cylinder 21, without the working medium 5 communicating with the thrust cylinder 21 while passing therethrough.

Figure 3:
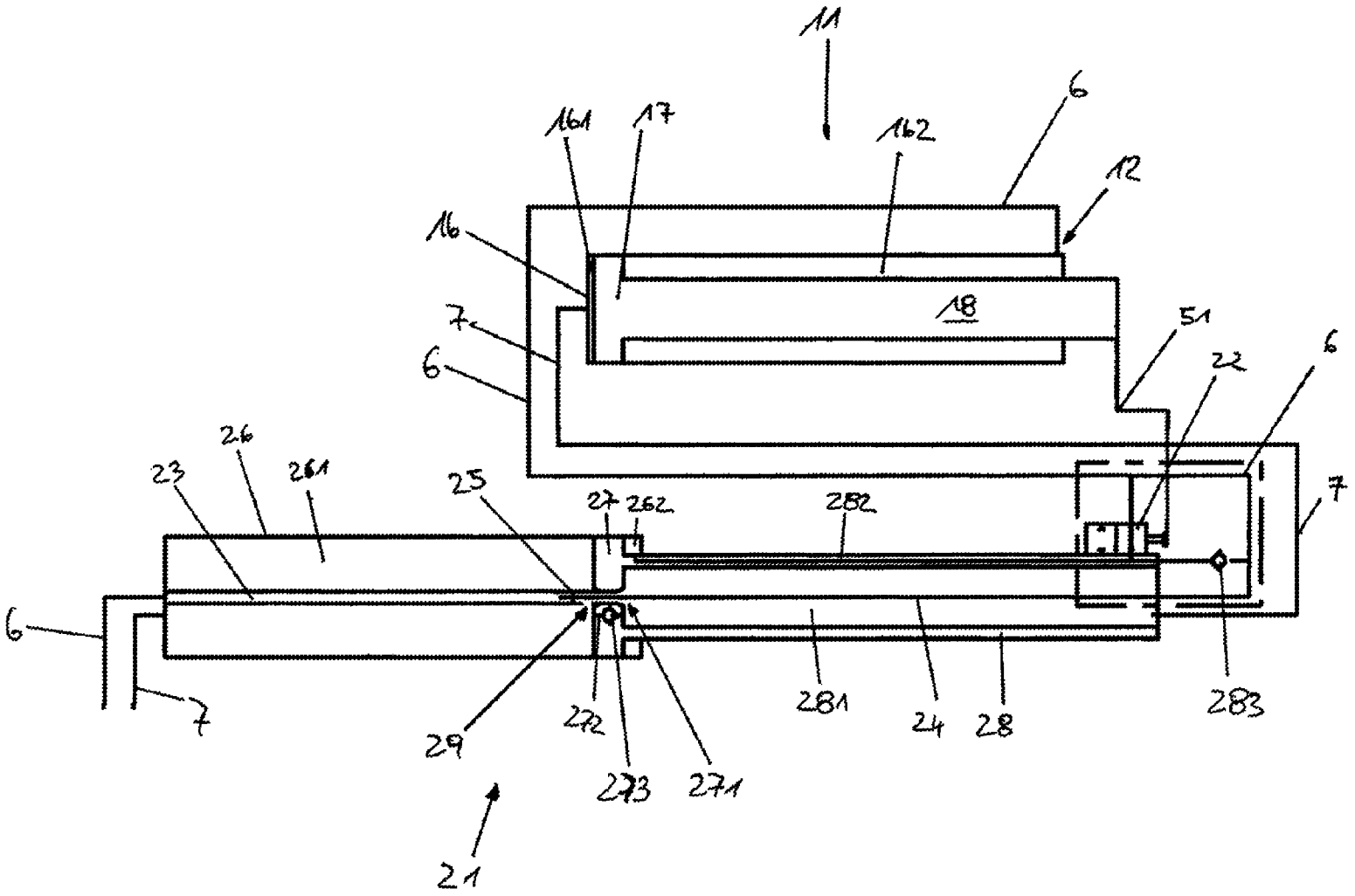
FIG. 3 shows a diagrammatic view of two thrust cylinders, wherein one thrust cylinder is completely extended and one thrust cylinder is retracted.

Retraction Process:

For the retraction process, the retraction line 6 is put under pressure. The working medium 5 (not shown) in the retraction line 6 occurs directly at the inlet opening 12 of the thrust cylinder 11 of the outer jib extension 1 (not shown). In that case, the retraction line 6 passes transversely through the thrust cylinder 21, through two telescopic tubes 23 and 24. The two tubes 23 and 24 are connected together by way of a seal 25, whereby no working medium can issue from the two tubes 23 and 24 towards the chambers 261 and 281 of the thrust cylinder 21, that surround those tubes 23 and 24. Due to pressurization in the retraction line 6, the working medium 5 is propagated in the chamber 262 surrounding the piston rod 18, whereby the piston rod 18 and the piston 17 are retracted (as shown in FIG. 3).

As soon as the thrust cylinder 11 is completely retracted, the switching valve 22 at the thrust cylinder 21 is preferably mechanically actuated by way of a lever 51, whereby the feed flow to the piston rod passage 282 is switched into the enabled condition for the working medium 5 of the retraction line 6. Opening of the switching valve could equally also be effected in any other conceivable fashion like, for example, electrically.

Now the working medium 5 in the retraction line 6 can flow by way of the control valve 22 and the piston rod passage 282 into the chamber surrounding the piston rod 28 and can be propagated therein, whereby the piston 27 and the piston rod 28 are retracted.

Because the two tubes 23 and 24 are telescopic, they are retracted at the same time with the piston 27 and the piston rod 28 (and likewise also extended in the extension process).

The working medium 5, which is not under pressure in the cylinder chamber 261, is urged out of the cylinder 26 in that retraction movement and can flow away by way of the extension line 7.

If a plurality of thrust cylinders 21 of that kind are connected in succession (see FIG. 4), then the working medium 5, which is flowing away in the extension line 7, can respectively flow away through the successively connected thrust cylinders 21, through the piston rod chamber 281, then through the extension passage 271 and then through the opening 29 in the tube 23 and through the cylinder chamber 261.

If the opening 29 of the tube 23 should already be closed again, as, for example, the piston 27 and the piston rod 28 are already retracted a distance and thus close the opening 29, the working medium 5 can nonetheless escape through that thrust cylinder 21 as the piston 27 has the retraction passage 272 which has a check valve 273. Thus, when the piston 27 or the piston rod 28 is partially or entirely retracted, oil 5 can flow out of the retraction line 7 by way of the piston rod 281, the check valve 273 of the retraction passage 272, and further by way of the cylinder chamber 261 through the thrust cylinder 21.

Such a configuration for a sequential control makes it possible to achieve both sequential extension of the thrust cylinders 21 and 11 and also sequential retraction of the thrust cylinders 11 and 21.

It is only when the thrust cylinder 21 is substantially completely extended that the working medium 5 is enabled for the thrust cylinder 11, and it is only then that the thrust cylinder 11 can be extended.

Equally, the thrust cylinder 21 can only be retracted when the thrust cylinder 11 is substantially completely retracted and in that case, the control valve 22 of the thrust cylinder 21 switches open, whereby it is only the thrust cylinder 21 that can retract.

Figure 4:
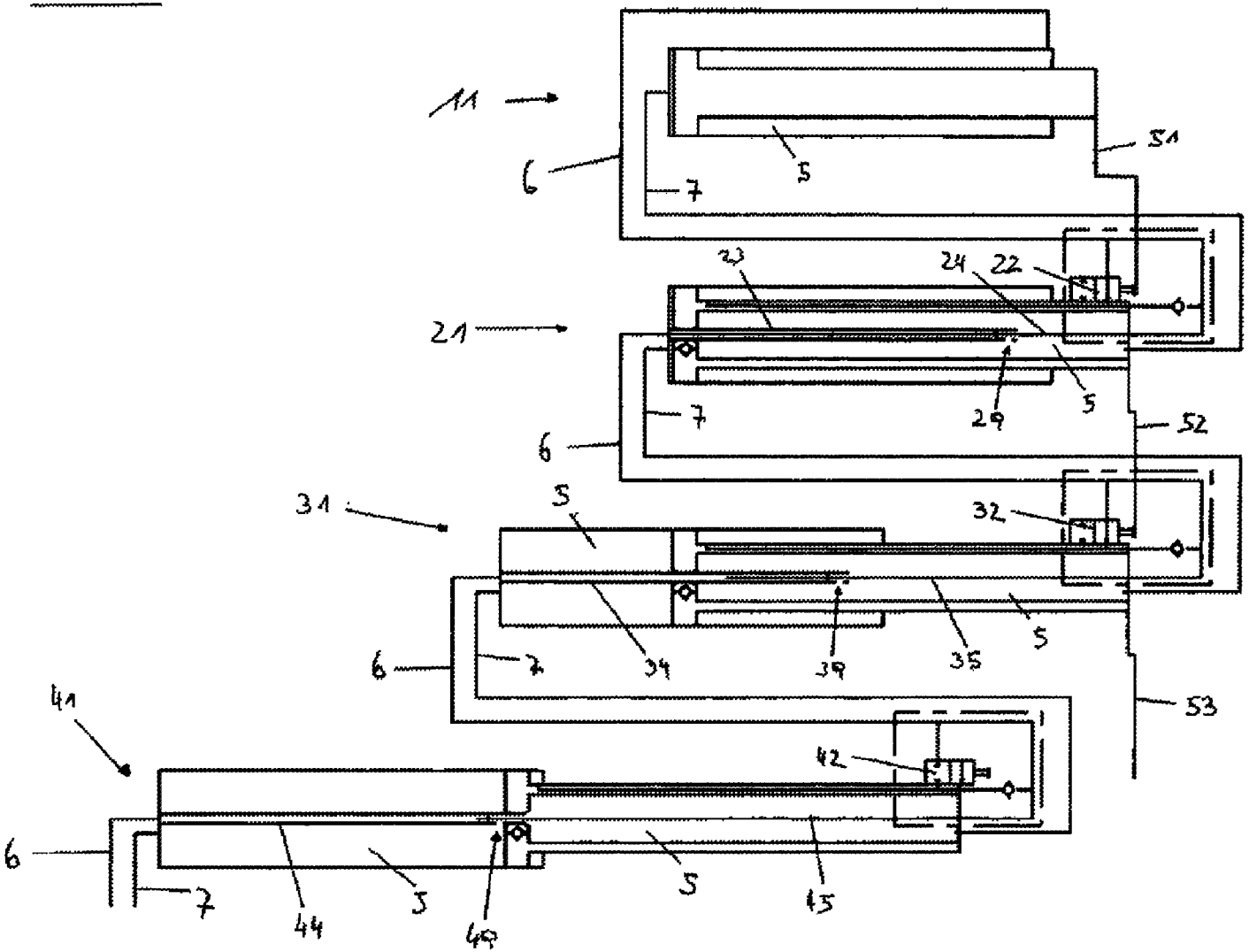
FIG. 4 shows a diagrammatic view of four thrust cylinders with a thrust cylinder for an outermost jib extension and three thrust cylinders for three inner jib extensions.

FIG. 4 shows a diagrammatic view of a hydraulically actuable jib 100 (see FIG. 1) for a load crane 101 (see FIG. 1). In this preferred embodiment, the hydraulically actuable jib 100 has four jib extensions 1, 2, 3 and 4 (see FIG. 1), wherein one jib extension is in the form of an outermost jib extension 1 and the other three jib extensions 2, 3 and 4 are in the form of inner jib extensions 2, 3 and 4. The jib extensions 1, 2, 3 and 4 each have at least one thrust cylinder 11, 21, 31 and 41 with which the jib extensions 1, 2, 3 and 4 can be retracted and extended. In this arrangement, the hydraulically actuable jib 100 has a hydraulic circuit for a working medium 5—in this preferred embodiment, the working medium being oil—with a retraction line 6 for pressurized retraction of the thrust cylinders 11, 21, 31 and 41, the retraction line 6 opening into the thrust cylinder 11 of the outermost jib extension 1. The jib 100 further has an extension line 7 for pressurized extension of the thrust cylinders 11, 21, 31 and 41. The thrust cylinders 21, 31 and 41 each have a switching valve 22, 32 and 42 which, by the attainment of a defined retraction position of the next outwardly disposed jib extension or its thrust cylinder 11, 21 and 31—in particular when the outer jib extension 1, 2 and 3 or the thrust cylinders 11, 21 and 31 thereof are substantially completely retracted—can be switched into the open position and thereby can feed pressurized working medium 5 to the next inner thrust cylinders 21, 31 and 41, respectively, of the inner jib extensions 2, 3 and 4. In that case, the working medium 5 of the retraction line 6 between a tank (not shown) and the inlet opening 12 at the thrust cylinder 11 of the outermost jib extension 1 does not communicate with the thrust cylinders 21, 31 and 41 of the inner jib extensions 2, 3 and 4 in any position of the thrust cylinders 21, 31 and 41 of the inner jib extensions 2, 3 and 4, as long as the outermost jib extension 1 or the thrust cylinder 11 has not reached its retraction position.

In this preferred embodiment, the retraction line 6 passes through all thrust cylinders 21, 31 and 41 of the inner jib extensions 2, 3 and 4 without the working medium 5 in the retraction line 6 communicating with the thrust cylinders 21, 31 and 41, during the passage therethrough.

In that case, the retraction line 6 is of a telescopic configuration in the interior of the thrust cylinders 21, 31, 41, by involving two internested tubes 23, 24 and 33, 34 and 43, 44, respectively, which are telescopically moveable relative to each other.

In that arrangement, the tubes 23, 33 and 43 are respectively provided stationarily in the cylinders of the associated thrust cylinders 21, 31 and 41, and the second tubes 24, 34 and 44 are respectively provided stationarily in the associated piston rods of the associated thrust cylinders 21, 31 and 41.

In this preferred embodiment, the outer tubes 23, 33 and 43 respectively have openings 29, 39 and 49 in peripheral surfaces of the associated tubes, those openings 29, 39 and 49 being formed at end regions of the tubes 23, 33 and 43, respectively.

In this preferred embodiment, the switching valves 22, 32 and 42 are in the form of 2/2-way valves and are actuated mechanically by way of the levers 51, 52 and 53.

The extension and retraction movement of those four illustrated thrust cylinders 11, 21, 31 and 41 functions in substance in the same way as depicted in the specific description relating to FIGS. 2 and 3.

Both extension and also retraction are effected sequentially, that is to say there is only ever one thrust cylinder 11, 21, 31 or 41 that extends or retracts. For that purpose, the working medium 5 is only ever enabled for operation for the next outwardly disposed thrust cylinder 31, 21 and 11 or for the next inwardly disposed thrust cylinder 21, 31 and 41, after substantially complete extension or retraction, respectively.

Figure 5:
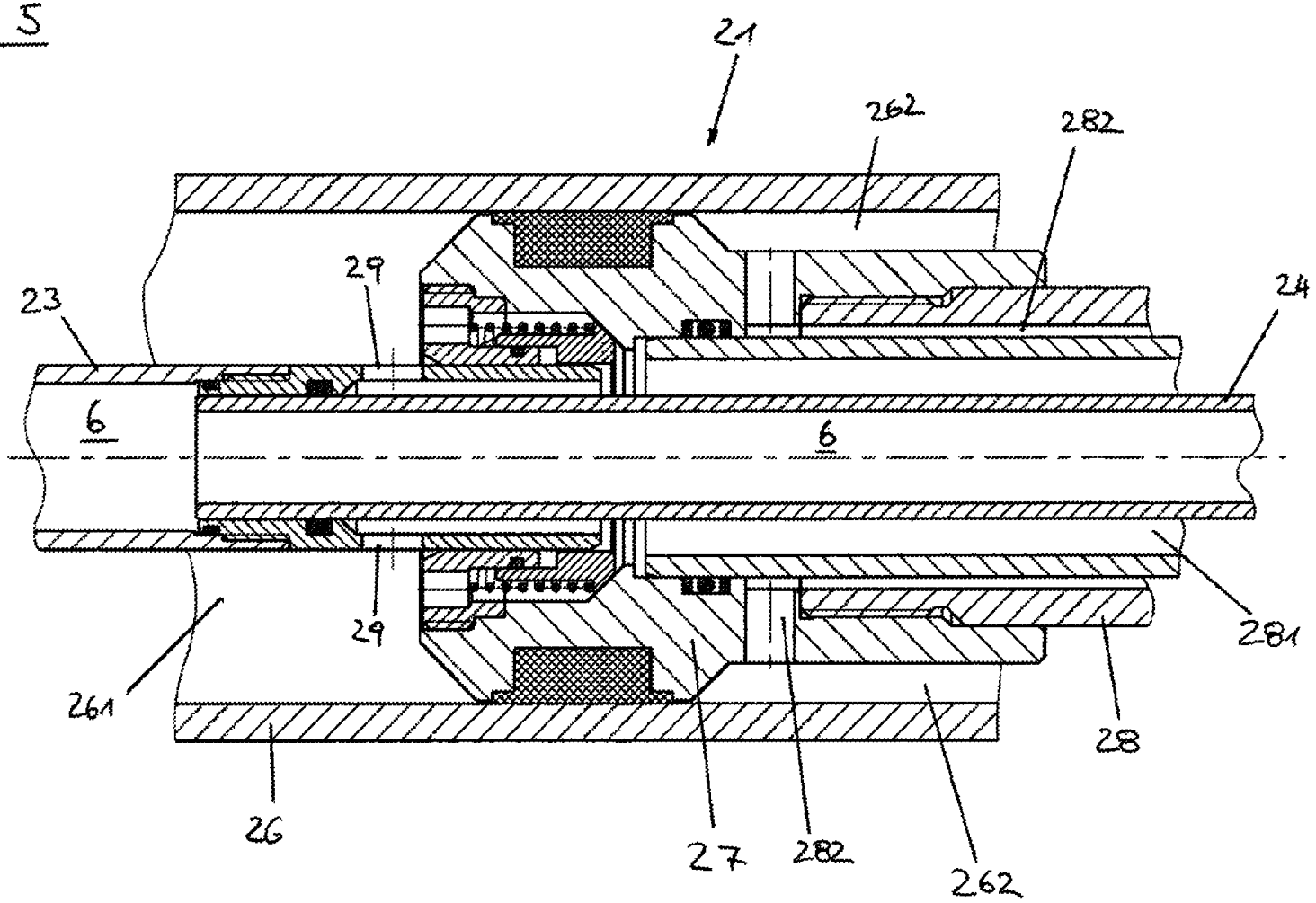
FIG. 5 shows a section through a detail view of a thrust cylinder.

FIG. 5 shows a detail view of a section through a thrust cylinder 21 in a position as shown in FIG. 3 when it is substantially fully extended.

The two telescopic tubes 23 and 24 extend in the interior of the thrust cylinder 21. In that case, those two tubes 23 and 24 also extend transversely through the cylinder 26, the piston 27 and the piston rod 28. The telescopic line 6 which is arranged in the thrust cylinder 21 and which consists of the two tubes 23 and 24 makes it possible for the oil 5 required for retraction to be passed through the thrust cylinder 21 (and 31 and 41 as shown in FIG. 4) forwardly to the thrust cylinder 11, wherein, in this preferred embodiment, the rear larger tube 23 is connected to the cylinder 26 and the smaller tube 24 is connected to the piston rod 28, the smaller tube 24 projecting into the larger tube 23 and being guided sealingly therein. The line 6 makes it possible to feed oil at the retraction side to the foremost thrust cylinder 11 which is not yet retracted (see FIG. 3), until it is entirely retracted. In that condition, the control valve 22 (see FIG. 3) is actuated (opened) to the next successive thrust cylinder 21. Thereupon, the thrust cylinder 21 can retract. The process is implemented in succession until all thrust cylinders 21, 31, 41 (see FIG. 4) are completely retracted.

This kind of control has the advantage over the previous kind that the control sequence is not at any moment determined by shutting off the return flow of oil, but always by controlled oil feed. The return oil flow is always free, both upon retraction and also upon extension.

The larger rearwardly disposed tube 23 is guided sealingly in the piston 27 and at the front end, after the seal or guide means, has an extension with radially arranged openings 29 which enable the flow of the piston-side oil through the piston 27 and the piston rod 28 forwardly in the extended condition.

In this arrangement, the piston 27 has a check valve (273) (see FIG. 3), which possibly opens when the piston 27 is slightly retracted, upon pressurization by the return oil flow, from the piston rod side, and enables the through-flow rearwardly.

Figure 6:
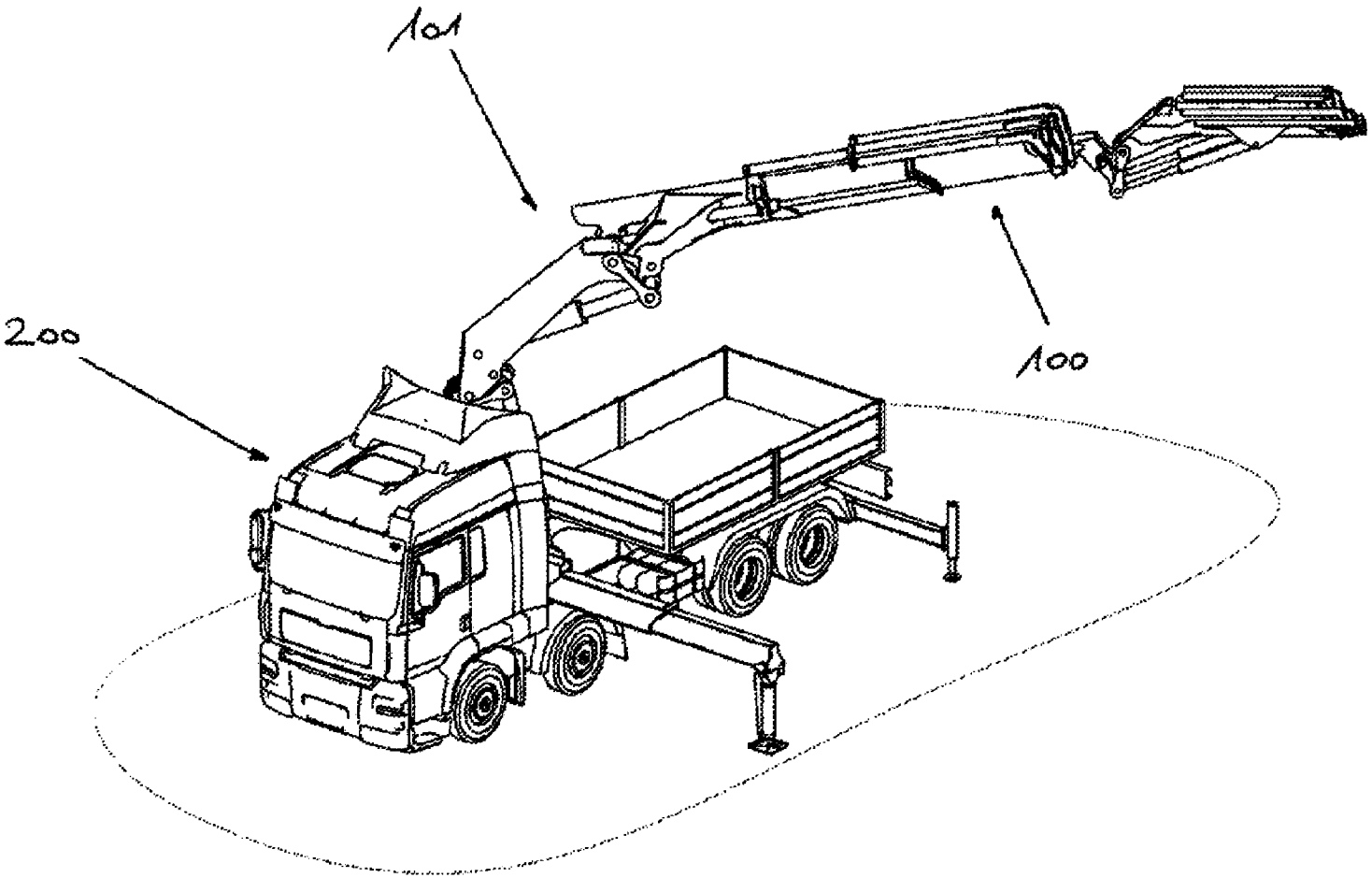
FIG. 6 shows a vehicle with a loading crane having a jib with jib extensions.

FIG. 6 shows a vehicle 200 with a loading crane 101 mounted thereon, having a hydraulically actuable jib 100 with jib extensions.

The invention claimed is:

1. A hydraulically actuable jib for a loading crane, comprising:

at least two jib extensions, wherein a first one of the at least two jib extensions is an outer jib extension and a second one of the at least two jib extensions is an inner jib extension, and at least two thrust cylinders for extension and retraction of the at least two jib extensions, a hydraulic circuit for a working medium, comprising a retraction line for pressure-actuated retraction of the at least two thrust cylinders, wherein a first one of the at least two thrust cylinders corresponds to the outer jib extension and a second one of the at least two thrust cylinders corresponds to the inner jib extension, a tank for delivery of the working medium, and a switching valve which is switchable into an open position by attainment of a defined retraction position of the outer jib extension and thereby is configured to feed the second one of the at least two thrust cylinders which corresponds to the inner jib extension with pressurized working medium, wherein the retraction line opens into the first one of the at least two thrust cylinders which corresponds to the outer jib extension and is adapted to be telescopic in an interior of the second one of the at least two thrust cylinders which corresponds to the inner jib extension, wherein the retraction line is continuous in any position of each of the at least two thrust cylinders with respect to a piston and a piston rod thereof, wherein the retraction line enters and exits the second one of the at least two thrust cylinders which corresponds to the inner jib extension at front and rear end regions of the second one of the at least two thrust cylinders which corresponds to the inner jib extension, wherein the retraction line is sealed from the second one of the at least two thrust cylinders which corresponds to the inner jib extension such that the retraction line only communicates with the second one of the at least two thrust cylinders which corresponds to the inner jib extension once the switching valve is switched into the open position by the attainment of the defined retraction position of the outer jib extension and thereby feeds the second one of the at least two thrust cylinders which corresponds to the inner jib extension with the pressurized working medium.

2. A jib as set forth in claim 1, wherein the retraction line passes through at least the second one of the at least two thrust cylinders which corresponds to the inner jib extension with the working medium in the retraction line being isolated from the working medium flowing back in the second one of the at least two thrust cylinders which corresponds to the inner jib extension during the passage therethrough.

3. A jib as set forth in claim 1, wherein a seal is provided between two internested tubes in the retraction line.

4. A jib as set forth in claim 1, wherein the second one of the at least two thrust cylinders which corresponds to the inner jib extension has at least one cylinder, at least one piston and at least one piston rod, and wherein a first tube is provided stationarily in the at least one cylinder of the second one of the at least two thrust cylinders which corresponds to the inner jib extension and a second tube is provided stationarily in the at least one piston rod of the second one of the at least two thrust cylinders which corresponds to the inner jib extension.

5. A jib as set forth in claim 4, wherein an outer one of the first tube and the second tube has an opening in a peripheral surface of the outer one of the first tube and the second tube, the opening being provided at an end region of the outer one of the first tube and the second tube.

6. A jib as set forth in claim 4, wherein the at least one piston has at least one extension passage, the at least one extension passage extending from a cylinder chamber into a piston rod chamber.

7. A jib as set forth in claim 6, wherein the at least one piston has at least one retraction passage, the at least one retraction passage extending from the cylinder chamber into the piston rod chamber, and a check valve being provided in the retraction passage.

8. A jib as set forth in claim 4, wherein the at least one piston rod has at least one piston rod passage, the at least one piston rod passage extending from a first end region of the at least one piston rod towards a second end region of the at least one piston rod, the switching valve being arranged at the first end region and a chamber surrounding the at least one piston rod being provided at the second end region, the chamber surrounding the at least one piston rod being provided in the at least one cylinder of the second one of the at least two thrust cylinders which corresponds to the inner jib extension.

9. A jib as set forth in claim 8, wherein at least one check valve is provided at the at least one piston rod passage.

10. A jib as set forth in claim 1, wherein the switching valve is a directional control valve.

11. A jib as set forth in claim 10, wherein the directional control valve is a 2/2-way valve.

12. A jib as set forth in claim 1, wherein the switching valve is adapted to be mechanically actuable.

13. A jib as set forth in claim 1, wherein the jib has at least one further inner jib extension with at least one thrust cylinder, wherein the working medium of the retraction line between the tank and an inlet opening at the first one of the at least two thrust cylinders which corresponds to the outer jib extension is isolated from the second one of the at least two thrust cylinders which corresponds to the inner jib extension or the at least one thrust cylinder of the at least one further inner jib extension in any position of the second one of the at least two thrust cylinders which corresponds to the inner jib extension or the at least one thrust cylinder of the at least one further inner jib extension as long as the outer jib extension has not reached the defined retraction position.

14. A jib as set forth in claim 13, wherein the at least one further inner jib extension is one of at least two further inner jib extensions.

15. A loading crane comprising a hydraulically actuable jib as set forth in claim 1.

16. A vehicle comprising a loading crane as set forth in claim 15.

17. A jib as set forth in claim 1, wherein the working medium is oil.

18. A jib as set forth in claim 1, wherein the switching valve is switchable into the open position by the attainment of the defined retraction position of the outer jib extension in a state in which the outer jib extension is substantially fully retracted, and thereby is configured to feed the second one of the at least two thrust cylinders which corresponds to the inner jib extension with the pressurized working medium.

* * * * *